US007216643B2

(12) United States Patent
Pellerite

(10) Patent No.: US 7,216,643 B2
(45) Date of Patent: May 15, 2007

(54) LASER-EQUIPPED PNEUMATIC TRAINING AID FOR SAFE DRAWING OF THE BOWSTRING

(75) Inventor: Bernard M. Pellerite, 1600 Reynoldsburg New Albany Rd., Blacklick, OH (US) 43004

(73) Assignee: Bernard M. Pellerite, Blacklick, OH (US)

( * ) Notice: Subject to any disclaimer, the term of this patent is extended or adjusted under 35 U.S.C. 154(b) by 234 days.

(21) Appl. No.: 10/858,157

(22) Filed: Jun. 1, 2004

(65) Prior Publication Data

US 2004/0216729 A1 Nov. 4, 2004

Related U.S. Application Data

(62) Division of application No. 10/360,170, filed on Feb. 7, 2003.

(51) Int. Cl.
*F41B 5/00* (2006.01)

(52) U.S. Cl. ..... 124/86; 124/87

(58) Field of Classification Search ..... 33/265, 33/DIG. 21; 124/23.1, 65, 66, 67, 86, 87; 434/11

See application file for complete search history.

(56) References Cited

U.S. PATENT DOCUMENTS 4,708,341 A * 11/1987 Paraskevakos ..... 482/120
5,224,464 A * 7/1993 Burnham et al. ..... 124/67
5,419,050 A * 5/1995 Moore ..... 42/115
5,495,675 A * 3/1996 Huang ..... 42/115
5,711,284 A * 1/1998 Keenan, Jr. ..... 124/49
6,094,829 A * 8/2000 Koestler, III ..... 33/265
6,366,344 B1 * 4/2002 Lach ..... 356/3.1
6,499,478 B1 * 12/2002 Perez ..... 124/86
6,796,038 B2 * 9/2004 Humphries ..... 33/265
6,862,813 B1 * 3/2005 Chen et al. ..... 33/265
2004/0014010 A1 * 1/2004 Swensen et al. ..... 434/21

* cited by examiner

*Primary Examiner*—John A. Ricci

(57) ABSTRACT

A pneumatic tube that is secured to the bow and bowstring with an arrow and piston inside for safe drawing and firing of an archery bow. When the archer looses the string and it drives the arrow forward, the piston creates pneumatic air resistance like a hand operated bicycle pump. This resistance is sufficient to prevent damage to the bow and/or its components from loosing the string without an actual arrow on the string. Normal loosing the string without an arrow on it is called "dry-firing" and would damage the bow and/or its components. This tube is attached to a bracket that is affixed to a mounting block that can be fastened to the front of the bow at the standard stabilizer mounting hole. There is also a laser mounted in the end of the tube, which can be turned on by the archer and projects a laser light on the target. This light is automatically turned off as the bow is fired, thus showing the archer exactly where an actual arrow would have hit. This device can be used without removing or disabling the arrow rest and is used in practice and to identify and then rectify any release flaws and other shooting maladies.

5 Claims, 4 Drawing Sheets

LASER-EQUIPPED PNEUMATIC TRAINING AID FOR SAFE DRAWING OF THE BOWSTRING

This Application is a Division of application Ser. No. 10/360,170, filed Feb. 7, 2003

1. FIELD OF THE INVENTION

This invention is in the field of archery training aids.

2. DESCRIPTION OF PRIOR ART

The main objective of the present invention is to enable the archer to safely draw back the bowstring of a bow that said invention is attached to, without removing the arrow rest, and allow the archer to release the bowstring without damaging said bow, for the purpose of exercise or practice, aiming, releasing and simulating arrow impact, without actually firing an arrow. All manufacturers of bows highly recommend not releasing a bowstring without an arrow, as it can severely damage the bow. This present invention allows the archer to draw and fire the bow for practice and exercise without damaging the bow this removable device is attached to.

SUMMARY OF THE INVENTION

A device and training aid for safe drawing, aiming and releasing of the bowstring is a pneumatic tube attached to a holding bracket, which is attached to a mounting block, which in turn is attached to the front of the bow in the standard stabilizer hole. It is not necessary to remove the arrow rest (a unique feature) for the purpose of mounting this device as is the case with previous inventions of this type. (See U.S. Pat. No. 4,708,341. This device clamps onto the handle riser and replaces the arrow rest. The archer would have to re-tune the bow every time the device was removed to be able to accurately shoot a real arrow from said bow, which is not practical or convenient.) This device consists of a tube with an arrow that has a piston attached at one end that is inside the tube. The other end of the arrow attaches to the bowstring. As the arrow is released, air pressure or an air blast is created, which is forced through a tiny hole in a plug, near the end of the tube. This blast of air then is directed against a sliding sleeve that encases a laser device held in a tube section forward of the plug. This sleeve can be withdrawn over the on/off button on the laser with a lever to project an intense, but safe laser dot of light on an intended target from the end of the tube. This device can be quickly and safely attached to any modern bow so the archer can draw and fire the bow without a conventional arrow on the string, which would ordinarily damage a bow and/or injure the archer. Another unique feature of this device is that the archer can turn on the laser light and practice shooting the bow anywhere without shooting an arrow. As the string is loosed, the air blast turns off the laser light. The archer can see where he or she would have hit with an arrow by noting where the light went off on the intended target. After practicing a smooth steady release technique, the archer can remove two attaching bolts and detach the device easily and return to shooting actual arrows at a target backstop.

BRIEF DESCRIPTION OF THE PICTURES AND DRAWINGS

REFERENCE NUMERALS

1. Pneumatic Tube
2. Bow Riser
3. Arrow
4. Air Piston
5. Bow String
6. Arrow Nocking Point
7. Arrow Rest
8. Laser Pointer
9. Hold Down Collar Device
10. Button/Switch
11. Fixture to Hold Laser
12. Pin
13. Slot
14. Air Hole
15. Coupling Plug
16. Nocking Groove
17. Set Screw
18. Protective Sleeve
19. Stabilizer Hole
20. Block
21. Screw
22. Step Down Hole
23. Stabilizer Adapter
24. Set Screw
25. Slots
26. Brace
27. Adjustment Holes
28. Nut
29. Bolt
30. Tube Clamp
31. Set Screws
32. External Laser Bracket

DESCRIPTION OF THE PREFERRED EMBODIMENTS

Figure 1:
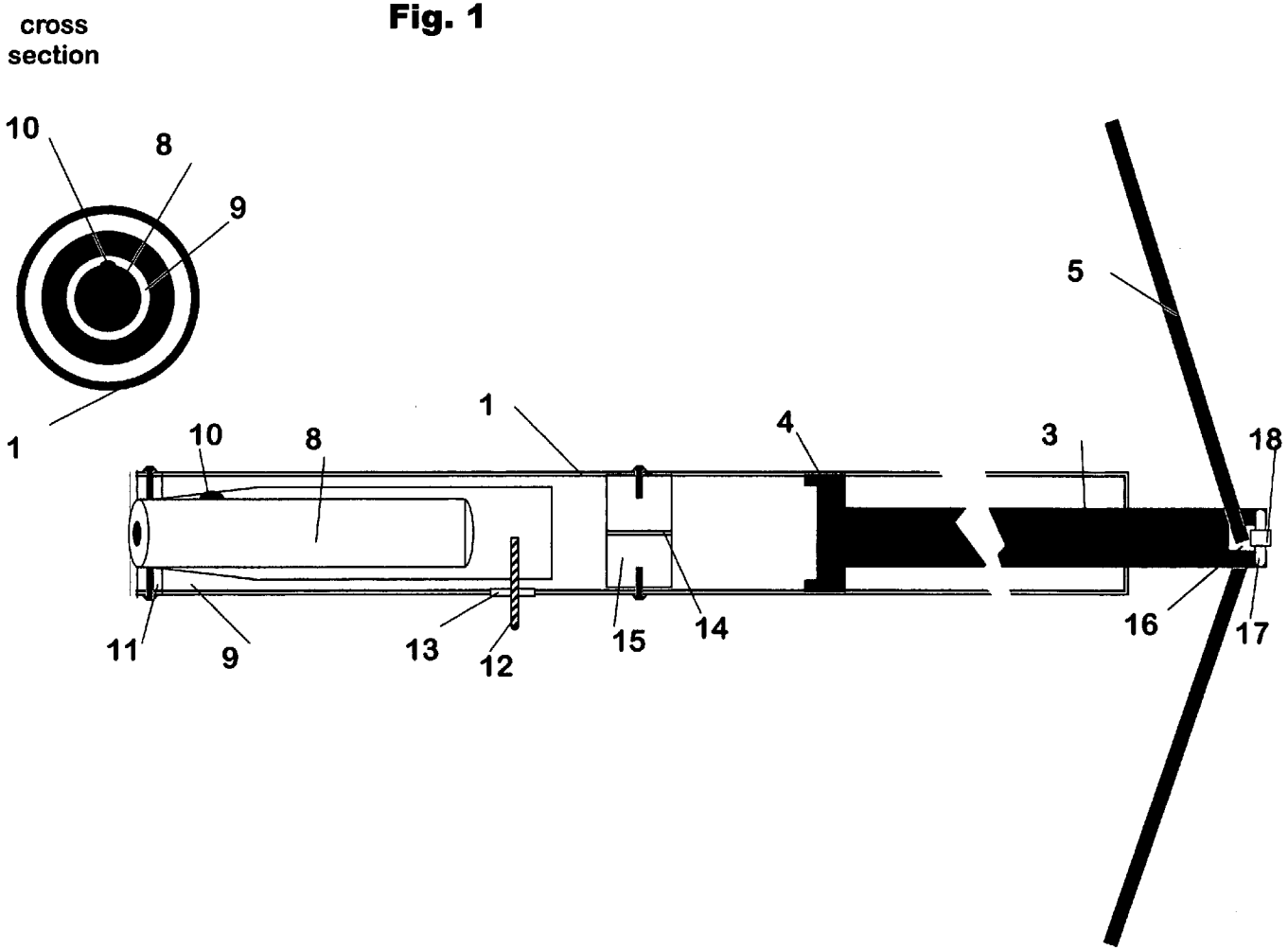
FIG. 1 Shows a cross section of the pneumatic tube and laser.
Figure 2:
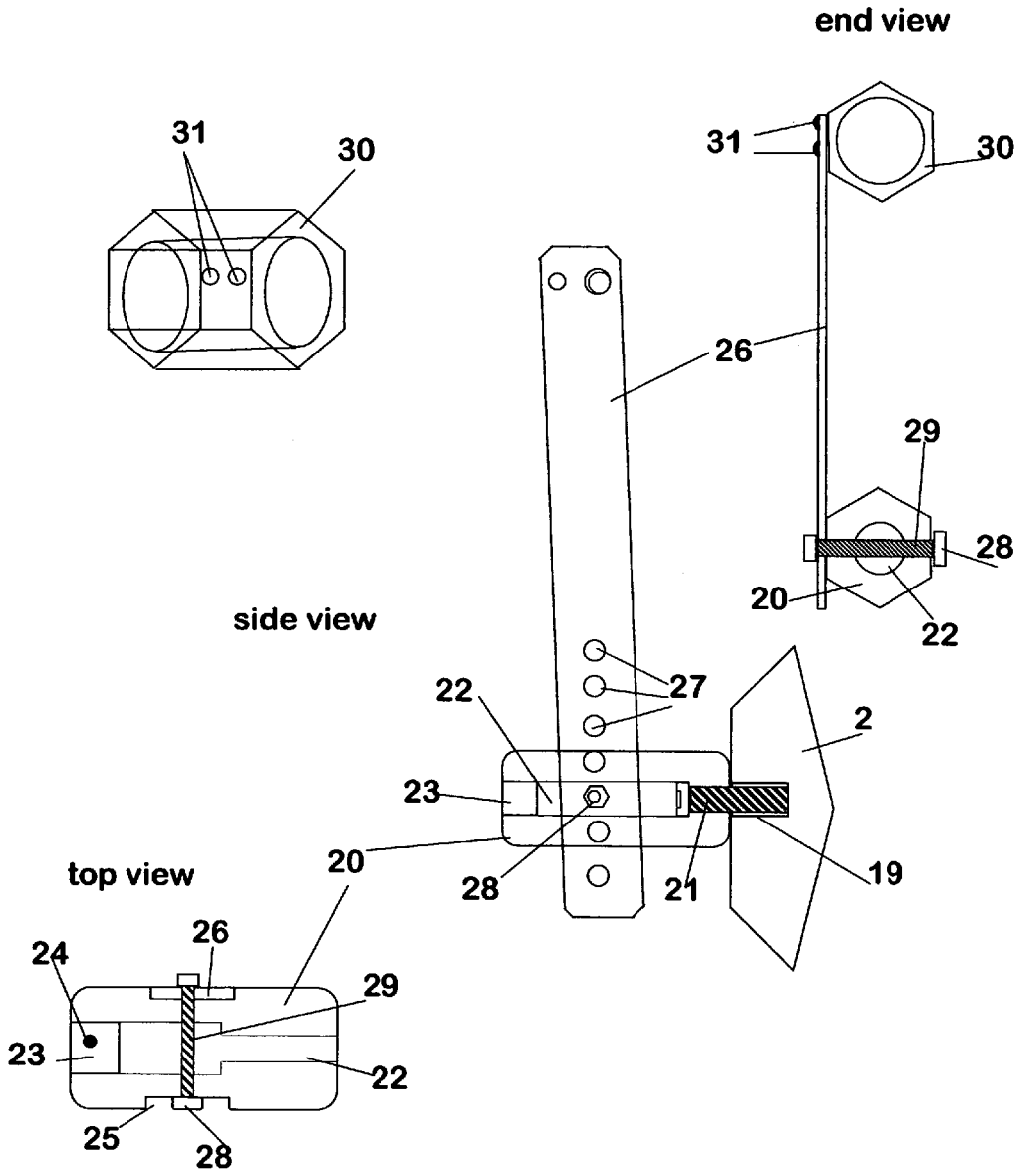
FIG. 2 Shows the bracket that attaches the pneumatic tube to the bow.
Figure 3:
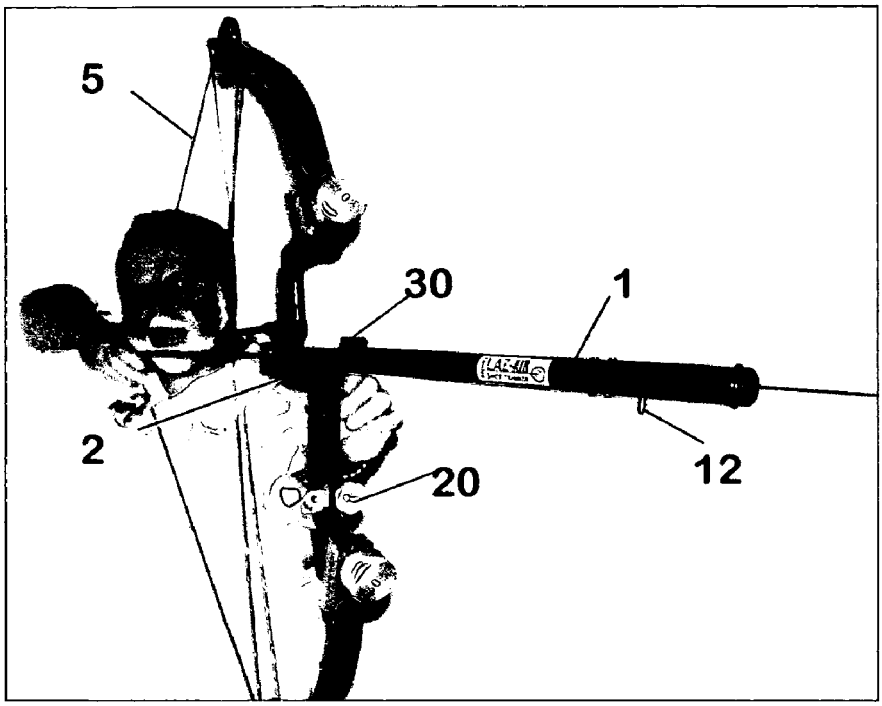
FIG. 3 Shows archer with pneumatic tube attached to bow.
Figure 4:
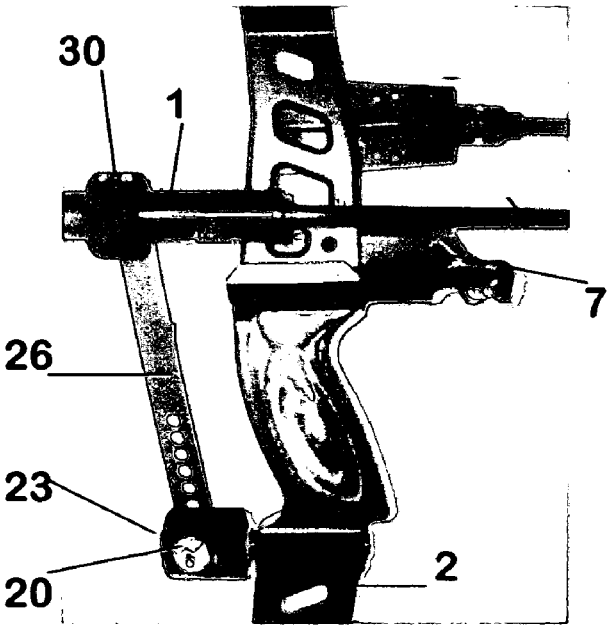
FIG. 4 Shows dose up of the bracket that attaches the pneumatic tube to the bow handle.
Figure 5:
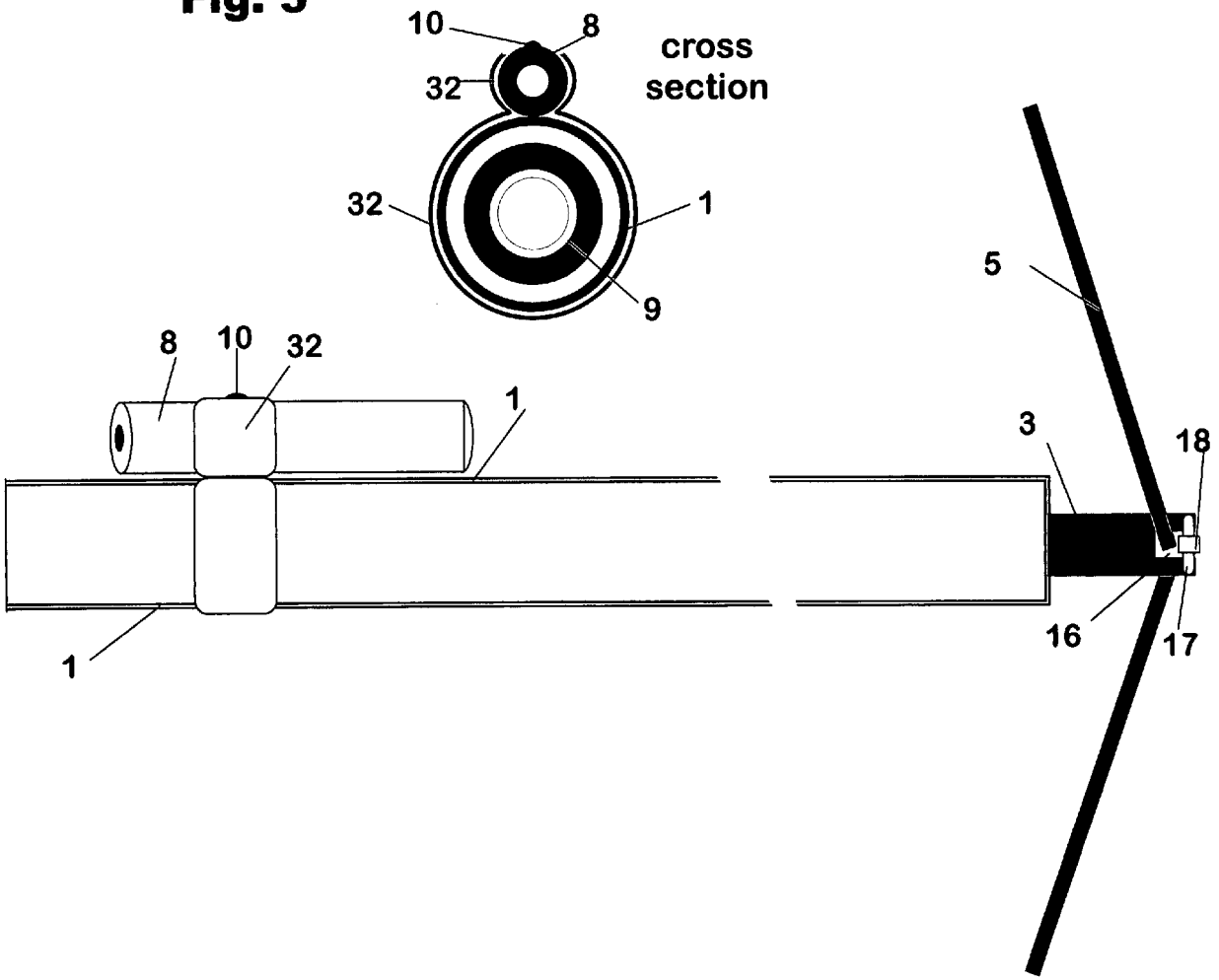
FIG. 5 Shows cross section and side view of how laser is to be mounted externally

A pneumatic tube (1) that is secured on a bow riser (2) with an arrow (3) and air piston (4) inside, with one end secured to the bowstring (5) at the arrow nocking point (6). The arrow (3) has an air piston (4) secured on one end that is inside the tube (1). As the archer draws the string (5) back, the air piston (4) is retracted rearward inside the tube (1). When the archer looses the string (5) and the string (5) drives the arrow (3) and piston (4) forward inside the secured pneumatic tube (1), the air piston (4) creates pneumatic air resistance like a hand operated bicycle pump. *Note: this "resistance" is sufficient to prevent damage to the bow and/or its components from loosing the string, without an actual arrow on the string. Normal loosing the string without an arrow on it is called "dry-firing" and would damage the bow and/or its components. The features of this training and archery practicing device are: the pneumatic tube is attached via a bracket (FIG. 2) on a bow to the stabilizer hole so the arrow (3) rides along slightly above the archer's affixed arrow rest (7). This allows the archer to remove and replace this device at will, without removing or modifying his existing arrow rest (7), or re-tuning his bow and arrow set-up.

A unique feature of this device is that a laser or laser pointer (8) is mounted inside the end of the pneumatic tube (1), opposite from the string (5). This laser (8) could also be mounted on the outside of the pneumatic tube (1) or on the bow handle-riser itself (2). The laser (8) is turned on with a hold down device (9) that depresses the button/switch (10) on the laser (8) before the archer draws the bowstring (5) back. In the case of the laser being externally mounted in the external bracket (32), the user would turn the laser one quarter of a turn so the button/switch (10) would contact the bracket (32) wall causing the button/switch (10) to become depressed and put in the ON position. As the string (5) is being drawn back, the laser (8) projects a small spot of light forward on a target, which shows the archer how steady he or she is aiming. As the string (5) is loosed, the hold down device (9) is forced off the button/switch (10) on the laser (8), which turns off the laser light. The archer can see when and where on the target the projected laser light or dot goes off. Therefore, the archer could predict where an actual arrow would have hit if he or she were to have one on the string (5). This type of practice is helpful to the archer when shooting actual archery arrows at a target is not desired or even possible.

The method of releasing the hold down laser button/switch (10) can be different, depending on whether the laser (8) is mounted on the inside or the outside of the pneumatic tube (1). If the laser (8) is mounted on the outside of the pneumatic tube (1) and the user wants to turn the laser (8) off, they turn the laser (8), in it's bracket (32) one quarter turn back to where the button/switch (10) is in the up position, where the button/switch (10) is no longer contacting the bracket (32). If the laser is on the inside in the front end, away from the archer, then the fixture (11) that holds the laser is mounted and secured inside the tube (1). The hold down collar device (9) has a pin (12) in the collar's side perpendicular to the tube (1) and the pin (12) is protruding through the tube (1) through a slot (13). The collar (9) is slid back toward the archer and over the laser button/switch (10), which depresses the button/switch (10). As the bowstring (5) is drawn and loosed, the air blast coming from inside the tube (1) is forced through a small hole (14) in the coupling lug (15) at the end of the tube (1), which created the pneumatic resistance and is sufficient to blow the collar (9) forward and allow the laser button/switch (10) to be released and the laser light goes off.

The arrow (3) is attached to the bowstring (5) by putting the bowstring (5) in the nocking groove (16) of the arrow (3), then inserting the set screw (17) to hold it in place. The set screw (17) has a protective sleeve (18) to keep the threads of the set screw (17) from cutting the bowstring (5).

The bracket for attaching the pneumatic tube (1) to the bow is attached via the stabilizer hole (19) on the bow handle/riser (2). The block (20) is attached to the bow with a screw (21), which goes through the step-down hole (22) through the center of the block (20). There is an adapter (23) in the end of the block (20) that presses in and is held in place with a set screw (24), so the archer can still use a stabilizer. There are two slots (25) in the sides of the block (20) to allow the brace (26) to be used on a right or left-handed bow. There are adjustment holes (27) in the brace (26) to allow for different size bows. The brace (26) is held in place in the appropriate slot (25) with a nut (28) and bolt (29). At the top of the brace (26), the tube clamp (30) is attached, which holds the pneumatic tube (1) in place. The tube clamp (30) has set screws (31) to tighten the tube clamp (30) around the pneumatic tube (1).

I claim:

1. An archery training device that attaches to a bow and consists of a pneumatic tube with a substitute arrow attached to a bow string on one end, and a piston on the other end, and as the string is drawn back and released, the substitute arrow and piston drives forward into the pneumatic tube, the piston fits inside the diameter of the tube tight enough to create resistance, which lets the bowstring down slow enough as to not damage the bow, and the forward driving piston causes a considerable air blast which is channeled through a small hole in an end plug of the tube; ahead of the plug there is second section of tubing that houses a small laser with an on/off button and this laser is secured at a forward end to the second section of tubing; a hollow sleeve with one closed end fits over a back end of the laser, and there is a lever affixed to the sleeve that protrudes on the outside of the second section of tubing, so the archer can pull back on the lever which slides the sleeve over the on/off button on the laser housing, which depress the button and turns on the laser, which projects an intense light on the intended target by which the archer can then practice aiming and firing a bow without arrows and without damage to the bow or injury to the archer.

2. The archery training device as described in claim 1, in which the laser projects a dot which is turned off automatically when the bowstring is released and the air blast from the piston hits a sealed flat end of the sleeve that covers the laser on/off button and said sleeve is blown forward off and away from the on/off button at which time the archer can then tell where he was aiming and predict where a real arrow would have gone by noting at what point and at what location on the target the laser dot went off and then the archer can slide the lever back to turn on the laser light and repeat the above process over and over, noting any jerking or lateral movement of the laser light just before it goes off, which allows the archer opportunity to change his style or method of shooting so that the light goes out while on target smoothly.

3. The archery training device as described in claim 1, further including a bracket that attaches the pneumatic tube to the front of the bow in the following manner: a small block with a bolt hole in it is secured to the front of the bow with a bolt at a right angle to and below the handle in a hole designed to screw on a front stabilizer; two opposing sides of said block have a groove in them that allows a vertical bracket with several adjustment holes to be affixed to either side, to accommodate right-handed or left-handed archers, and said bracket rises at an angle of 10 degrees or more in relation to the bow handle, which angles the at away from the archers hand so as not to interfere with said hand; on the top end of said bracket is affixed a clamp that secures around the pneumatic tube and keeps it in place while the bow is dawn and fired.

4. The archery training device as described in claim 3, in which the block and attached bracket is mounted so as to be removable and replaceable on the bow.

5. The archery training device as described in claim 3, in which the block includes a removable piece that has a threaded hole for mounting a stabilizer, while the archery training device is attached to the bow.

* * * * *